United States Patent [19]

Bellos et al.

[11] 4,213,934

[45] Jul. 22, 1980

[54] USE OF PHOSPHORYLATED OXYALKYLATED POLYOLS IN CONJUNCTION WITH SULFITE AND BISULFITE OXYGEN SCAVENGERS

[75] Inventors: Thomas J. Bellos, Kirkwood, Mo.; James E. Davis, Houston, Tex.

[73] Assignee: Petrolite Corporation, St. Louis, Mo.

[21] Appl. No.: 887,148

[22] Filed: Mar. 16, 1978

[51] Int. Cl.[2] ..... C09K 15/32; C23F 11/08; C23F 11/16; C23F 11/18

[52] U.S. Cl. ..... 422/15; 166/244 C; 210/58; 252/8.55 B; 252/8.55 D; 252/8.55 E; 252/389 A

[58] Field of Search ..... 21/2.7 R, 2.7 A; 166/244 C, 244 R; 210/57, 58; 422/12, 13, 15; 252/8.55 B, 8.55 D, 8.55 E, 389 R, 389 A

[56] References Cited

U.S. PATENT DOCUMENTS

| | | | |
|---|---|---|---|
| 3,502,587 | 3/1970 | Stanford et al. | 210/58 |
| 3,580,855 | 5/1971 | Mickus et al. | 252/181 |
| 3,728,420 | 4/1973 | Stanford et al. | 210/58 |
| 3,793,194 | 2/1974 | Zecher | 210/58 |
| 3,899,293 | 8/1975 | Bush | 21/2.7 A |

*Primary Examiner*—Bradley R. Garris

*Attorney, Agent, or Firm*—Sidney B. Ring; Hyman F. Glass

[57] ABSTRACT

This invention relates to the use of phosphorylated oxyalkylated polyols (POP) in conjunction with sulfite oxygen scavengers in inhibiting corrosion in oxygen-containing systems. The phosphorylated oxyalkylated polyols are effective in inhibiting the precipitation of the sulfite and bisulfite oxygen scavengers as scale.

11 Claims, No Drawings

USE OF PHOSPHORYLATED OXYALKYLATED POLYOLS IN CONJUNCTION WITH SULFITE AND BISULFITE OXYGEN SCAVENGERS

Sulfite and bisulfite salts such as sodium or ammonium sulfites are effective oxygen scavengers in oxygen-containing systems thus reducing or inhibiting corrosion caused by the presence of oxygen in the system. However such sulfites, when employed in hard or scale-producing water, are rendered less effective due to their precipitation as scale. Thus, hard water not only decreases the effectiveness of sulfites as oxygen scavengers but also creates problems due to scale formation.

We have now discovered a method of preventing the precipitation of sulfites as scale, which precipitation renders such sulfites less effective as oxygen scavengers, by a process which comprises the use of the phosphorylated oxyalkylated polyols in conjunction with the sulfites.

The suitability of the additives of this invention is determined by two tests.

Test (1) Solubility Test

To 50 cc of 10% by wgt. solution of $CaCl_2$ is added 0.5 cc of a 50% solution, by wgt. of the sulfite or bisulfite which also contains about 5%, by weight, of the POP. In order to pass this test a clear solution, (i.e., having no visible precipitation) is formed within 5 minutes of the addition.

Test (2) Oxygen Scavenger Test

The presence of POP in the brine of Test (1) must not interfere with the oxygen scavenging properties of the sulfite or bisulfite solution. Stated another way, the presence of POP does not appreciably reduce the oxygen scavenging ability of the sulfite or bisulfite, i.e., its ability to convert the dissolved oxygen to an innocuous form.

The uniqueness of this invention is illustrated by comparing the use of the phosphates of this invention with the phosphonates of U.S. Pat. No. 3,899,293. In contrast to the clear solutions formed with the phosphates of this invention without any appreciable reduction in the sulfite or bisulfite's ability to scavenge oxygen, the phosphonates of U.S. Pat. No. 3,899,293 not only form precipitates but also diminish the sulfite and bisulfite's ability to scavenge oxygen.

The oxyalkylated polyols which are phosphorylated according to this invention are ideally represented by the following formula $$R[(AO)_nH]_x$$

where R is an organic and preferably hydrocarbon moiety of the polyol, OA is the oxyalkylene moiety derived from the alkylene oxide, for example ethylene oxide, propylene oxide, butylene oxides, etc., and mixtures or block units thereof, n is the number of oxyalkylated units and x represents the total number of units containing OH groups.

Preferred polyols include glycerol, polyglycerol, trimethanolethane, pentaerythritol, dipentaerythritol, etc., mannitol, 1,2,3 hexanetriol, etc.

A number of processes are known in the art for preparing the phophorylated polyols. A preferred process is to react polyphosphoric acid with a polyol. The polyphosphoric acid should have a $P_2O_5$ (i.e., phosphorus pentoxide) content of at least about 72 percent, preferably about 82 percent to 84 percent. A residue of orthophosphoric acid and polyphosphoric acid remains on completion of the reaction. This residue may be as high as about 25%–50% of the total weight of the phosphorylated polyol. It may either be removed or left in admixture with the phosphorylated polyol. Preferably the phosphorylated polyols produced by the process are prepared employing amounts of a polyphosphoric acid having about 0.5–1 molar equivalents of $P_2O_5$ for each equivalent of the polyol used. Larger amounts of polyphosphoric acid can be used if desired. By "equivalent of the polyol" is meant the hydroxyl equivalents of the polyol. For example, one mole of glycerol is three equivalents thereof, and so forth. The phosphorylated polyols (acid esters) can be partially or completely converted to their corresponding alkali metal salts or ammonium salts by reacting with appropriate amounts of alkali metal hydroxides or ammonium hydroxide.

The compositions are polyfunctional acid phosphate esters of polyhydric alcohols, said esters having the formula $R\text{-}(OPO_3H_2)_x$ wherein R is the hydrocarbyl group of a polyhydric alcohol (i.e., R is any remaining organic residue of a polyhydric alcohol used as the starting material) and x is a number from 2 to 6, said esters often being referred to in the art as phosphorylated polyols.

The sulfite compounds useful in this invention are selected from the group consisting of alkali metal sulfites, ammonium sulfite, alkali metal bysulfite, and ammonium bisulfite. The preferable sulfite compound is sodium sulfite, $Na_2SO_3$.

The concentration of sulfite compound in aqueous solution is not critical and may be any concentration up to saturation. Preferably the solution will contain from 5% up to saturation of the sulfite compound as lower concentrations require the handling of excessively large volumes of solution.

The concentration of the POP must be sufficient to prevent scale formation in the aqueous solution. Preferably the concentration of the POP is from 1 to 20% by weight based on the concentration of the sulfite compound.

It is preferred in the practice of this invention to prepare a sulfite composition which contains the sulfite compound in admixture with the POP prior to forming the aqueous solution. In this manner only one product needs to be shipped and handled to prepare an aqueous sulfite solution which is useful as an oxygen scavenger to reduce the harmful effects of oxygen in aqueous systems, particularly the formation of scale. Such aqueous systems may be at remote, relatively inaccessible locations such as drilling fluids for oil and gas wells and waterflood treating solutions for increasing the recovery of oil from petroleum containing formations.

Thus it is preferred to prepare a sulfite composition containing a major proportion of a sulfite compound selected from the group consisting of alkali metal sulfites, alkali metal bisulfites, ammonium sulfite, ammonium bisulfite, and mixtures thereof, and a POP in an amount sufficient to prevent scale formation.

Preferably the sulfite composition contains from 1 to 20% by weight, based on the concentration of the sulfite compound, of POP.

The aqueous sulfite solutions of this invention are particularly useful in reducing the corrosion of ferrous metals which are in contact with an aqueous system containing dissolved oxygen and at least one metallic cation selected from the group consisting of ferrous ($Fe^{++}$), cobaltous ($Co^{++}$), nickelic ($Ni^{++}$), manganous ($Mn^{++}$), and cupric ($Cu^{++}$).

The corrosion of ferrous metals in contact with such a system is decreased by the removal of the oxygen from the system. This is preferably accomplished by adding to the aqueous system sufficient quantities of the aqueous sulfite solution described herein to provide an excess sulfite ($SO_3^{--}$) concentration in the system of from 20 parts per million parts by weight (ppm) to 100 ppm above the concentration of sulfite required to react with the oxygen in the system. Thus for (X) ppm of oxygen in the aqueous system to be treated, the amount of sulfite to be added is 5(X) ppm plus 20 to 100 ppm.

The corrosion of a ferrous metal contacted by the aqueous system will be reduced in proportion to the amount of oxygen removed from the system. Total removal of the molecular oxygen in the system will effectively eliminate the corrosion of the ferrous metal which is caused by the presence of the oxygen in the system. Thus it is preferable that the sulfite compound and the oxygen react to remove essentially all of the oxygen from the system before contacting the ferrous metal with the system.

It is well known that metallic cations such as the ferrous, cobaltous, nickelic, manganous, and cupric cations act as catalysts to speed up the rate of reaction between the sulfite anion and oxygen. The aqueous system to be treated must contain a concentration of at least one of these cations which is sufficient to catalyze the reaction of the sulfite compound with the oxygen in the system in order to provide a fast reaction rate such that the treated system need not be held in a retaining tank or other storage vessel until the sulfite compound and the oxygen have had time to react before contacting the ferrous metal.

The concentration of metallic cation needed to effectively catalyze the reaction is dependent upon the concentration of other multivalent cations in the aqueous system. Thus in a relatively pure water to be treated wherein the catalytic metallic cation is the only cation present, the concentration of the cation required to catalyze the reaction is much greater than would be required if the stabilizing compound were not present. In this case the concentration of catalytic metallic cation in the system is about 5 ppm. As the concentration of other multivalent cations in the system increases, particularly the hardness cations calcium and magnesium, the concentration of the catalytic metallic cation needed to effectively catalyze the reaction between the sulfite and oxygen decreases. Oil field brines containing high concentrations of hardness cations need contain only about 0.5 ppm or more the catalytic metallic cation to produce a fast reaction rate. Apparently these other multivalent cations complex with the stabilizing compound preventing the stabilizing compound from complexing with the catalytic metallic cation or at least delaying its reaction with the catalytic metallic cation until after the metallic cation has catalyzed the reaction between the sulfite compound and the oxygen.

The preferred aqueous systems to be treated with the aqueous sulfite solution of this invention are low solids water base drilling fluids, flood waters used in treating subterranean formations, and waste effluents pumped into disposal wells.

Low solids drilling fluids contain less than about 6% solids and generally contain one or more polymers which function as viscosifiers, suspending agents, bentonite beneficients and shale flocculants. Representative low solids drilling fluids are disclosed in the following U.S. patents, incorporated herein by reference: U.S. Pat. Nos. 3,070,543 (Scott); 3,323,603 (Lummus et al.); 3,338,320 (Gilson et al.); 3,360,461 (Anderson et al.).

The use of sulfites to reduce the corrosion of well drilling tools, drill pipe and oter ferrous surfaces during drilling operations is disclosed in U.S. Pat. No. 3,301,323 (Parsons), incorporated herein by reference.

Flood waters used in treating subterranean formations in secondary recovery operations to increase the yield of petroleum from such formations are generally either fresh ground watersas obtained from lakes, rivers, wells and the like, and brine waters obtained from producing wells. The use of sulfites in flood waters is described in the following U.S. patents, incorporated herein by reference: U.S. Pat. Nos. 3,119,447 (Raifsnider et al.); 3,258,072 (Froning).

The following examples will further illustrate the invention and are not intended to limit the invention. The limits of the invention are incorporated into the appended claims.

Table I

| Phosphorylated Oxyethylated Polyols | | | |
|---|---|---|---|
| Ex. | | Moles of EtO/ mole of Polyol | Moles of Polyphosphoric Acid/ mole of polyol |
| A | Pentaerythritol | 4 | 3.4 |
| B | Commercially available Aminoethylene phosphonate | — | — |
| C | Commercially available Aminomethylene phosphonate | — | — |
| D | Commercially available amino (poly hydroxy ethyl) phosphate | — | — |
| E | Pentaerythritol | 6 | 4 |
| F | Pentaerythritol | 8 | 4 |
| G | Pentaerythritol | 4 | 4 |
| H | Glycerine | 1 | 3 |
| I | Glycerine | 2 | 3 |
| J | Glycerine | 3 | 3 |
| K | Glycerine | 4 | 3 |
| L | Glycerine | 5 | 3 |
| M | Tri(methylol) propane | 1 | 3 |
| N | Tri(methylol) propane | 2 | 3 |
| O | Tri(methylol) propane | 3 | 3 |
| P | Tri(methylol) propane | 4 | 3 |
| Q | Tri(methylol) propane | 5 | 3 |

In addition, the above compositions may contain less than a stoichiometric equivalent of polyphosphoric acid. Those containing as low a stoichiometric equivalent of 60% mole percent of polyphosphoric are also effective in this invention.

The following tests were carried out as follows:

I. Solubility Tests

A stock 10% $CaCl_2$ solution is prepared using distilled water. In a constant temperature (75° F.) bath 50 ml portions of the stock 10% $CaCl_2$ solution are added to 100 ml graduated cylinders. After the solutions have come to equilibrium (temp.) 0.5 cc of a 50% by wgt. solution of the sulfite or bisulfite also containing about 5% by weight of POP are added to each graduate. Each graduate cylinder is agitated for two minutes after which they are returned to the 75° F. bath and observed for their clarity on each. The graudate cylinders are observed at the end of 5.0 minutes, at 10 min., 30 min. and 1 hr. The condition of the solution is noted e.g. soluble, hazy, cloudy spontaneous precipitation. The solution either remains clear, hazy, cloudy or the product causes spontaneous precipitation. The best compounds remain clear to hazy and pass the oxygen scavenging test.

II. Oxygen Scavenging Test.

The oxygen meter used in these studies is the Model 54 Oxygen Meter, manufactured by Yellow Springs Instrument Company, Inc. The vessel was a 1,000 ml Erlenmeyer flask with a rubber stopper made to hold the probe of the Oxygen Meter, and an injection needle for scavengers. The test cell was placed on a magnetic stirrer, allowing satisfactory mixing of brines and chemicals.

Table II-continued

| Oxygen Scavenger Solution** | Solubility Tests: Initial Injection | 5 min | 10 min | 30 min | 1 hr. |
|---|---|---|---|---|---|
| Q | clear | — | — | — | — |

*SP -spontaneous precipitation

**The oxygen scavenger solution contains 50% by wgt. of $(NH_4)_2SO_3$ and 4.5% by wgt. of POP of the Example of Table I indicated. The standard is the 50% solution without POP. 0.5 cc of the oxygen scavenger solution is added to 50 cc of 10% by wgt. $CaCl_2$ at 75° F.

***where a dash (—) is used, it means no change from prior reading.

Table III

| Oxygen Scavenger Solution* | Temp. of Test Brine | $O_2$ Content ppm | Oxygen Scavenging Test: $O_2$ Content in ppm against time in seconds 30 | 60 | 90 | 120 | 180 | 240 | 300 | 360 | 420 | |
|---|---|---|---|---|---|---|---|---|---|---|---|---|
| Standard | 22° C. | 7.7 | 5.7 | 3.0 | 2.2 | 1.8 | 1.2 | 1.0 | 0.8 | 0.7 | 0.7 | |
| Std.+4.5% Composition A | 22° C. | 7.2 | 4.5 | 2.2 | 1.5 | 1.2 | 0.9 | 0.7 | 0.6 | 0.6 | 0.6 | |
| Std.+4.5% Composition B | 22° C. | 7.1 | 7.0 | 6.9 | 6.8 | 6.6 | 6.2 | 4.5 | 2.6 | 1.2 | 1.1 | phosphonates |
| Std.+4.5% Composition C | 22° C. | 7.2 | 7.1 | 7.0 | 7.0 | 7.0 | 7.0 | 7.0 | 7.0 | 7.0 | 7.0 | phosphonates |
| Std.+4.5% Composition D | 22° C. | 7.1 | 6.9 | 6.7 | 5.0 | 2.7 | 1.2 | 0.9 | 0.7 | 0.6 | 0.6 | |
| Std.+4.5% Composition E | 22° C. | 7.2 | 5.0 | 2.7 | 1.9 | 1.4 | 1.0 | 0.8 | 0.7 | 0.6 | 0.6 | |
| Std.+4.5% Composition F | 22° C. | 7.1 | 5.1 | 2.8 | 1.9 | 1.5 | 1.0 | 0.9 | 0.7 | 0.6 | 0.6 | |
| Std.+4.5% Composition G | 22° C. | 7.4 | 5.0 | 2.7 | 1.8 | 1.5 | 1.0 | 0.9 | 0.7 | 0.6 | 0.6 | |
| Std.+4.5% Composition H | 22° C. | 7.1 | 5.2 | 2.8 | 2.0 | 1.7 | 1.0 | 0.9 | 0.7 | 0.6 | 0.6 | |
| Std.+4.5% Composition I | 22° C. | 7.2 | 5.1 | 2.7 | 1.9 | 1.7 | 1.0 | 0.9 | 0.7 | 0.6 | 0.6 | |
| Std.+4.5% Composition J | 22° C. | 7.1 | 5.0 | 2.5 | 1.8 | 1.4 | 1.0 | 0.9 | 0.7 | 0.6 | 0.6 | |
| Std.+4.5% Composition K | 22° C. | 7.4 | 5.0 | 2.6 | 1.8 | 1.5 | 1.0 | 0.9 | 0.8 | 0.6 | 0.6 | |
| Std.+4.5% Composition L | 22° C. | 7.4 | 5.0 | 2.6 | 1.8 | 1.5 | 1.0 | 0.9 | 0.8 | 0.6 | 0.6 | |
| Std.+4.5% Composition M | 22° C. | 7.1 | 5.3 | 2.7 | 2.1 | 1.8 | 1.2 | 1.0 | 0.7 | 0.6 | 0.6 | |
| Std.+4.5% Composition N | 22° C. | 7.2 | 5.2 | 2.6 | 1.9 | 1.9 | 1.0 | 0.9 | 0.7 | 0.6 | 0.6 | |
| Std.+4.5% Composition O | 22° C. | 7.6 | 5.0 | 2.6 | 1.8 | 1.4 | 1.0 | 0.9 | 0.7 | 0.6 | 0.6 | |
| Std.+4.5% Composition P | 22° C. | 7.6 | 5.0 | 2.7 | 1.9 | 1.5 | 1.0 | 0.9 | 0.7 | 0.6 | 0.6 | |
| Std.+4.5% Composition Q | 22° C. | 7.4 | 5.0 | 2.7 | 1.9 | 1.5 | 1.0 | 0.9 | 0.7 | 0.6 | 0.6 | |

*The oxygen scavenger solution contains 50% by wgt. of $(NH_4)_2SO_3$ and 4.5% by wgt.of the POP of the Example of Table I indicated. The standard is the 50% oxygen scavenger solution without POP.

The water chosen for this study consisted of a synthetic sea water. This salinity is found to afford optimum scavenging rate with conventional sulfite scavengers under common conditions (i.e. pH8, temperature 22° C.).

The amount of initial oxygen is recorded and a 10:1 scavenger/$O_2$ ratio is injected into test cell. Time is measured with a stopwatch and amounts of $O_2$ are recorded every 15 seconds for a reasonable period of time.

Table II

| Oxygen Scavenger Solution** | Solubility Tests: Initial Injection | 5 min | 10 min | 30 min | 1 hr. |
|---|---|---|---|---|---|
| Standard | SP* | —*** | — | — | — |
| A | Clear | — | — | — | — |
| B | SP | — | — | — | — |
| C | SP | — | — | — | — |
| D | hazy | — | — | — | — |
| E | clear | — | — | — | — |
| F | clear | — | — | — | — |
| G | clear | — | — | — | — |
| H | hazy | cloudy | — | — | — |
| I | hazy/clear | hazy | — | — | — |
| J | clear | — | — | — | — |
| K | clear | — | — | — | — |
| L | clear | — | — | — | — |
| M | hazy/cloudy | cloudy | — | — | — |
| N | hazy/clear | hazy | — | — | — |
| O | clear | — | — | — | — |
| P | clear | — | — | — | — |

The oxygen content of the water in the Examples in Table III was found to be about 7+ ppm (YSI Meter determination). Therefore the water was treated with 80 ppm (0.08 cc) of the oxygen scavenger solution. A stopwatch is started and the oxygen scavenging converts the oxygen to sulfate. The time needed to accomplish this is recorded.

The additive should not have an adverse effect but it need not improve the characteristics of the scavenging. If the scavenger with POP is equal to or better than the results obtained with the scavenger alone and has the added feature of not forming a precipitate in the solubility test section (Table II), the test is successful.

The above tables demonstrate the effectiveness of the compositions of this invention as demonstrated by the results in Tables II and III.

These tests demonstrate that the two commercial phosphonates are ineffective in these tests. Not only do they interfere with the scavenging effects of ammonium bisulfite but also cause spontaneous precipitation of calcium sulfite when added to a 10% $CaCl_2$ solution. (Table II) In contrast, aminoethyl phosphate is effective in that it does not effect the oxygen scavenging effect of ammonium bisulfite solution; however, is less effective than the polyol containing no amino groups.

Field Test

In the field at a location in Arkansas Composition A was applied to a water injection well containing 10 ppm oxygen and containing 1200 ppm $Ca^{++}$. The injection well plugged up twice a day before the injection of Composition A. After applying Composition A the well required no shut down for cleaning out calcium sulfite scale.

In summary, this invention relates to the use in conjunction with bisulfite and sulfite oxygen scavengers of phosphorylated polyols oxyalkylated with about 1 to 20 or more moles of alkylene oxide, preferably ethylene oxide, per mole of polyol, the polyol having at least three hydroxyl group such as 3–10 hydroxyl group, for example 3–6 but preferably 4–5. The oxyalkylated polyol is phosphorylated with about 0.5 to 2.0 moles of polyphosphoric acid per hydroxyl group, such as from about 0.6 to 1.5, but preferably about 1–1.3 moles. The phosphorylated oxyalkylated polyol is generally employed as the acid but salts such as an alkali metal salt, an ammonium or amine salt, for example as sodium, potassium, ammonium, alkanolamine salts, such as mono, di, or tri ethanol amine salts, etc. may also be employed.

We claim:

1. In a process of inhibiting corrosion of ferrous surfaces in an oxygenated aqueous system wherein oxygen scavengers of the sulfite and bisulfite type are employed, the improvement which comprises adding thereto a minor amount of phosphorylated oxyalkylated polyol which is sufficient to substantially prevent the precipitation of the sulfite or bisulfite without substantially affecting its oxygen scavenging properties.

2. The process of claim 1 where the oxyalkylated polyols are stoichiometrically only partially phosphorylated.

3. The process of claim 1 where the phosphorylated oxyalkylated polyols are employed in the form of alkali metal, ammonium or amine salts.

4. The process of claim 1 where the oxyalkylated polyol is an oxyethylated polyol.

5. The process of claim 4 where the oxyethylated polyol is oxyethylated glycerol, oxyethylated pentaerythritol or oxyethylated trimethylol propane.

6. An oxygen scavenging composition for an oxygenated aqueous system comprising an oxygen scavenging amount of a sulfite compound of the group consisting of alkali metal sulfites, ammonium sulfite alkali metal bisulfites, ammonium bisulfite and mixtures thereof in admixture with a phosphorylated oxyalkylated polyol in a minor amount sufficient to substantially prevent the precipitation of the sulfite compound without substantially affecting its oxygen scavenging properties

7. A composition of claim 6 containing a major proportion of said sulfite compound and a scale preventing amount of phosphorylated oxyalkylated polyol.

8. A composition of claim 7 wherein the oxyalkylated polyols are stoichiometrically only partially phosphorylated.

9. A composition of claim 7 where the phosphorylated oxyalkylated polyols are in the form of alkali metal, ammonium or amine salts.

10. A composition of claim 7 wherein the oxyalkylated polyol is an oxyethylated polyol.

11. A composition of claim 10 wherein the oxyethylated polyol is oxyethylated glycerol, oxyethylated pentaerythritol or oxyethylated trimethylol propane.

* * * * *